US008306250B2

(12) United States Patent
Watanabe

(10) Patent No.: US 8,306,250 B2
(45) Date of Patent: Nov. 6, 2012

(54) SOUND REPRODUCING APPARATUS USING IN-EAR EARPHONE

(75) Inventor: Yasuhito Watanabe, Kanagawa (JP)

(73) Assignee: Panasonic Corporation, Osaka (JP)

( * ) Notice: Subject to any disclaimer, the term of this patent is extended or adjusted under 35 U.S.C. 154(b) by 574 days.

(21) Appl. No.: 12/663,562

(22) PCT Filed: Apr. 3, 2009

(86) PCT No.: PCT/JP2009/001574

§ 371 (c)(1),
(2), (4) Date: Dec. 8, 2009

(87) PCT Pub. No.: WO2009/125567

PCT Pub. Date: Oct. 15, 2009

(65) Prior Publication Data

US 2010/0177910 A1 Jul. 15, 2010

(30) Foreign Application Priority Data

Apr. 10, 2008 (JP) ..... 2008-102275

(51) Int. Cl.
*H04R 25/00* (2006.01)
*H04R 29/00* (2006.01)

(52) U.S. Cl. ..... 381/328; 381/60; 381/74

(58) Field of Classification Search ..... 381/312, 381/328, 26, 58, 60, 71.6, 74, 309, 310, 91, 381/92, 122, 375, 380; 181/130, 135; 607/57
See application file for complete search history.

(56) References Cited

U.S. PATENT DOCUMENTS 6,658,122 B1 * 12/2003 Westermann et al. ..... 381/312
6,687,377 B2 * 2/2004 Voix et al. ..... 381/60
7,082,205 B1 * 7/2006 Westermann ..... 381/312
7,313,241 B2 * 12/2007 Hamacher et al. ..... 381/60
7,715,577 B2 * 5/2010 Allen et al. ..... 381/312
7,953,229 B2 * 5/2011 Saito et al. ..... 381/58

(Continued)

FOREIGN PATENT DOCUMENTS

JP 5-199596 8/1993

(Continued)

OTHER PUBLICATIONS

International Search Report issued May 26, 2009 in International (PCT) Application No. PCT/JP2009/001574.

*Primary Examiner* — Xu Mei
(74) *Attorney, Agent, or Firm* — Wenderoth, Lind & Ponack, L.L.P.

(57) ABSTRACT

First, in a state where a pair of earphones 110 are worn in both ears of a listening person, a measurement signal generated by a measurement signal generating section 101 is outputted from the earphone 110. The signal (wearing-state signal) which is reflected by an eardrum and returns to the earphone 110 is measured, and stored in an analysis section 108. Next, in a state where the pair of earphones 110 are not worn in both ears of the listening person, a signal measured (unwearing-state signal) in the same manner as described above is stored in the analysis section 108. The analysis section 108 calculates an ear-canal correction filter based on a difference between the wearing-state signal and the unwearing-state signal. An ear-canal correction filter processing section 109 convolves a sound source signal with the calculated ear-canal correction filter.

20 Claims, 17 Drawing Sheets

U.S. PATENT DOCUMENTS

| | | | | |
|---|---|---|---|---|
| 7,957,549 | B2 * | 6/2011 | Chiba et al. | 381/328 |
| 8,050,421 | B2 * | 11/2011 | Fukuda et al. | 381/94.1 |
| 8,081,769 | B2 * | 12/2011 | Fukuda et al. | 381/71.6 |
| 8,111,849 | B2 * | 2/2012 | Tateno et al. | 381/317 |
| 2004/0196991 | A1 | 10/2004 | Iida et al. | |

FOREIGN PATENT DOCUMENTS

| | | |
|---|---|---|
| JP | 2000-92589 | 3/2000 |
| JP | 2002-209300 | 7/2002 |
| JP | 2003-102099 | 4/2003 |
| JP | 2008-177798 | 7/2008 |

* cited by examiner

SOUND REPRODUCING APPARATUS USING IN-EAR EARPHONE

TECHNICAL FIELD

The present invention relates to a sound reproducing apparatus for reproducing a sound by using an in-ear earphone.

BACKGROUND ART

A sound reproducing apparatus using an in-ear earphone is compact, highly portable, and useful. On the other hand, since wearing an earphone in an ear blocks an ear canal, there arises a problem that the sound is slightly muffled and that it is difficult to obtain a spacious sound.

For example, let it be assumed that the ear canal of an ear is represented by a simple cylindrical model. When not wearing an earphone in the ear, the cylinder is closed at the eardrum side and is open at the entrance side of the ear, that is, one end of the cylinder is open and the other end is closed ((a) in FIG. 16). In this case, a primary resonance frequency is about 3400 Hz if it is assumed that the length of the cylinder is 25 mm which is an average length of the ear canal of a human. On the other hand, when wearing an earphone 110 in the ear, the cylinder is closed at the eardrum side and the entrance side of the ear, that is, both ends of the cylinder are closed ((b) in FIG. 16). In this case, a primary resonance frequency is about 6800 Hz which is double that in the case of not wearing an earphone.

One of techniques to solve the above problem is a conventional sound reproducing apparatus which corrects a resonance frequency characteristic of an ear canal to reproduce a sound, thereby realizing a listening state equivalent to that in the case of not wearing an earphone (in the case where the ear canal is not blocked), even when, actually, wearing the earphone in the ear (for example, see Patent Document 1).

FIG. 17 shows a configuration of a conventional sound reproducing apparatus 1700 disclosed in Patent Document 1. In the conventional sound reproducing apparatus 1700 shown in FIG. 17, a correction information storage section 1703 stores correction information about an ear-canal impulse response variation, and a convolution operation section 1704 convolves a sound source signal with the correction information, thereby realizing a listening state equivalent to that in the case where the ear canal is not blocked.

Moreover, there is a conventional acoustic-field reproducing apparatus which automatically measures a head-related transfer function of a listening person with use of an in-ear transducer used for both a microphone and an earphone, and convolves an inputted signal with the measured head-related transfer function of the listening person, and which allows the listening person to receive the convolved signal via the in-ear transducer used for both a microphone and an earphone (for example, see Patent Document 2). The conventional acoustic-field reproducing apparatus realizes, through the above processing, the effect of allowing an unspecified listening person to obtain excellent feeling of localization of a plurality of sound sources present in all directions.

Patent Document 1 Japanese Laid-Open Patent Publication No. 2002-209300

Patent Document 2 Japanese Laid-Open Patent Publication No. H05-199596

DISCLOSURE OF THE INVENTION

Problems to be Solved by the Invention

However, the conventional sound reproducing apparatus disclosed in Patent Document 1 has a problem that a characteristic of a pseudo head is used for a characteristic of ear-canal correction.

In addition, the conventional acoustic-field reproducing apparatus disclosed in Patent Document 2 measures a head-related transfer function between a speaker and each ear of the listening person, from an input from the speaker and an output from the in-ear transducer used for both a microphone and an earphone. In addition, it is disclosed that, since a point where the measurement is performed coincides with a point where a sound is reproduced, an optimum head-related transfer function can be measured. However, there is a problem that, since an earphone normally has a speaker for reproduction directed toward the inside of an ear, the microphone itself is an obstacle, and therefore a head-related transfer function cannot properly be measured.

Therefore, an object of the present invention is to provide a sound reproducing apparatus capable of realizing a listening state which is suitable for an earphone for listening and is equivalent to a listening state in the case where the ear canal is not blocked even when wearing the earphone, by obtaining a filter for correcting a characteristic of an ear canal of an individual with use of an earphone used for listening and convolving a sound source signal with the filter.

Solution to the Problems

The present invention is directed to a sound reproducing apparatus reproducing sound by using an in-ear earphone. In order to achieve the above object, one aspect of a sound reproducing apparatus of the present invention comprises a measurement signal generating section, a signal processing section, an analysis section, and an ear-canal correction filter processing section.

The measurement signal generating section generates a measurement signal. The signal processing section outputs the measurement signals from an in-ear earphone to an ear canal of a listening person by using a speaker function, and measures, with the in-ear earphone, the signals reflected by an eardrum of the listening person by using a microphone function of the in-ear earphone, both in a state where the in-ear earphone is worn in the ear of the listening person and in a state where the in-ear earphone is not worn in the ear of the listening person. The analysis section analyzes the signals measured in the two states by the signal processing section, and obtains an ear-canal correction filter. The ear-canal correction filter processing section convolves the sound source signal with the ear-canal correction filter obtained by the analysis section, when sound is reproduced from a sound source signal.

The signal processing section may measure a signal in a state where the in-ear earphone is attached to an ear-canal simulator which simulates a characteristic of an ear canal, instead of the state where the in-ear earphone is not worn in the ear of the listening person. In addition, if the analysis section stores a standard ear-canal correction filter which is measured in advance by using the ear-canal simulator which simulates a characteristic of an ear canal, the analysis section can correct the standard ear-canal correction filter and obtain an ear-canal correction filter, based on the signal measured in the state where the in-ear earphone is worn in the ear of the listening person.

It is preferable that the standard ear-canal correction filter is stored as a parameter of an IIR filter. In addition, the analysis section may perform processing on a characteristic obtained through the measurement, only within a range of frequencies causing a change in a characteristic of the ear canal. The range of frequencies causing a change in a characteristic of the ear canal is, for example, from 2 kHz to 10 kHz.

In addition, an HRTF processing section for convolving the sound source signal with a predetermined head-related transfer function may further be provided at a preceding stage of the ear-canal correction filter processing section. Alternatively, an HRTF processing section for convolving the sound source signal convolved with the ear-canal correction filter with a predetermined head-related transfer function, may further be provided at a subsequent stage of the ear-canal correction filter processing section. Alternatively, the analysis section may store a predetermined head-related transfer function and obtain an ear-canal correction filter convolved with the head-related transfer function. Alternatively, the analysis section may calculate a simulation signal for a state where the in-ear earphone is not worn in the ear of the listening person by performing resampling processing on the signal measured by the signal processing section in the state where the in-ear earphone is worn in the ear of the listening person. Typically, the measurement signal is an impulse signal.

Effect of the Invention

According to the present invention, a characteristic of an ear canal of an individual is measured by using an earphone used for listening, and thereby an optimum ear-canal correction filter can be obtained. Thus, a listening state which is suitable for an earphone for listening and is equivalent to a listening state in the case where the ear canal is not blocked, can be realized, even when wearing an earphone.

DESCRIPTION OF THE REFERENCE CHARACTERS

Figure 1:
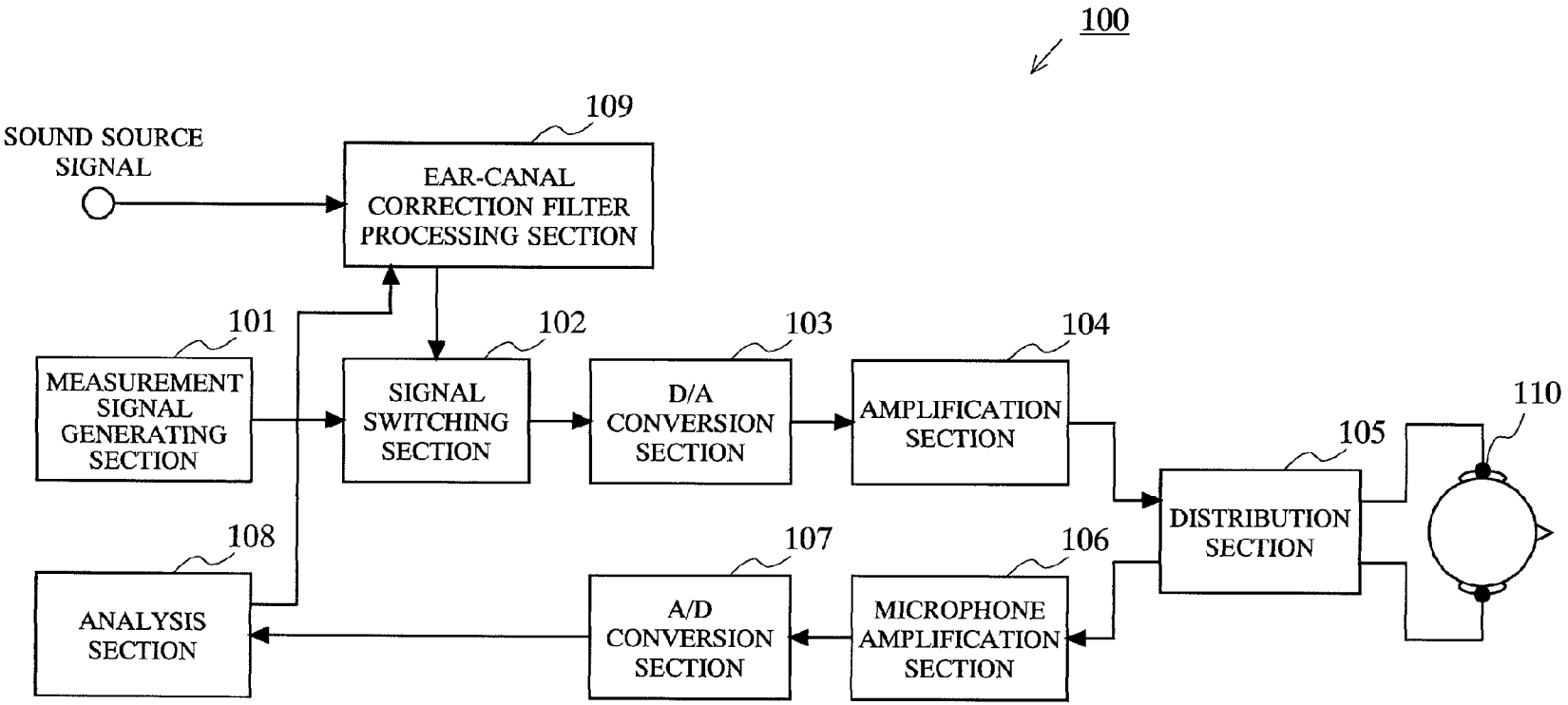
FIG. 1 shows a configuration of a sound reproducing apparatus 100 according to a first embodiment of the present invention.

100, 200, 300, 400 sound reproducing apparatus
101 measurement signal generating section
102 signal switching section
103 D/A conversion section
104 amplification section
105 distribution section
106 microphone amplification section
107 A/D conversion section
108, 308, 408, 508 analysis section
109 ear-canal correction filter processing section
110 earphone
111 signal processing section
114, 414, 514 FFT processing section
115, 415 memory section
116, 416 coefficient calculation section
117 IFFT processing section
121 ear-canal simulator
212 HRTF processing section
318 convolution processing section
319 HRTF storage section
420 standard ear-canal correction filter storage section
501 PC
518 resampling processing section

BEST MODE FOR CARRYING OUT THE INVENTION

First Embodiment

FIG. 1 shows a configuration of a sound reproducing apparatus 100 according to a first embodiment of the present invention. As shown in FIG. 1, the sound reproducing apparatus 100 includes a measurement signal generating section 101, a signal switching section 102, a D/A conversion section 103, an amplification section 104, a distribution section 105, a microphone amplification section 106, an A/D conversion section 107, an analysis section 108, an ear-canal correction filter processing section 109, and an earphone 110. The signal switching section 102, the D/A conversion section 103, the amplification section 104, the distribution section 105, the microphone amplification section 106, and the A/D conversion section 107 constitute a signal processing section 111.

Firstly, an outline of each component of the sound reproducing apparatus 100 according to the first embodiment will be described.

The measurement signal generating section 101 generates a measurement signal. The measurement signal generated by the measurement signal generating section 101, and a sound source signal which has passed through the ear-canal correction filter processing section 109, are inputted to the signal switching section 102, and the signal switching section 102 outputs one of the inputted signals by switching therebetween in accordance with a reproduction mode or a measurement mode described later. The D/A conversion section 103 converts a signal outputted by the signal switching section 102 from digital to analog. The amplification section 104 amplifies the analog signal outputted by the D/A conversion section 103. The distribution section 105 supplies the amplified signal outputted by the amplification section 104 to the earphone 110, and supplies a signal to be measured when the earphone 110 is operated as a microphone to the microphone amplification section 106. The earphones 110 are worn in both ears of a listening person as a pair of in-ear earphones. The microphone amplification section 106 amplifies the measured signal outputted by the distribution section 105. The A/D conversion section 107 converts the amplified signal outputted by the microphone amplification section 106 from analog to digital. The analysis section 108 analyzes the converted amplified signal to obtain an ear-canal correction filter. The ear-canal correction filter processing section 109 performs convolution processing on the sound source signal with the ear-canal correction filter obtained by the analysis section 108.

Next, operation of the sound reproducing apparatus 100 according to the first embodiment will be described.

The sound reproducing apparatus 100 executes processing in the measurement mode for calculating the ear-canal correction filter to be given to the ear-canal correction filter processing section 109 by using the measurement signal, before executing processing in the reproduction mode for performing sound reproduction based on the sound source signal.

1. Measurement Mode

Figure 3:
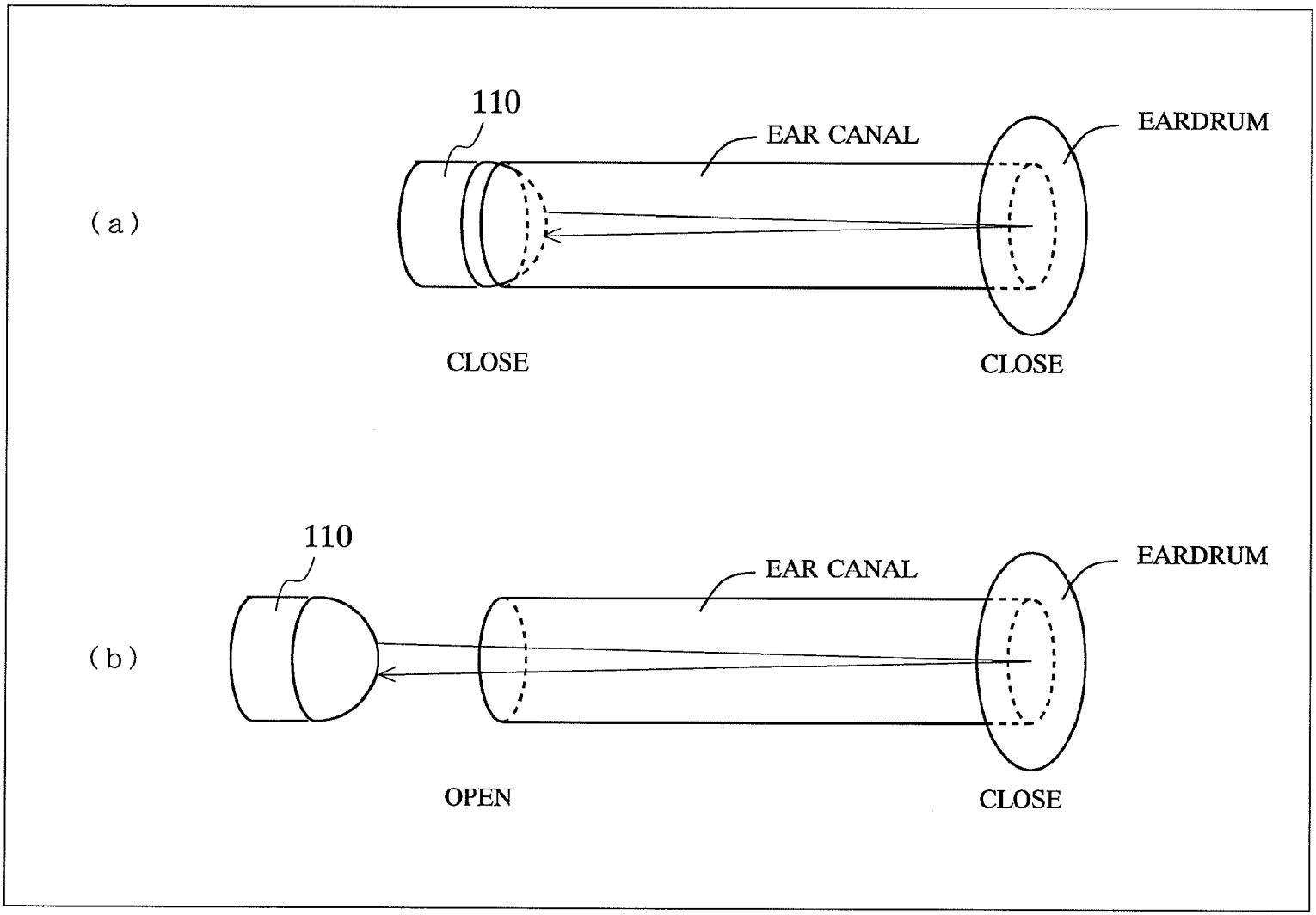
FIG. 3 shows states of wearing and not wearing earphones 110 in the ear.

First, the sound reproducing apparatus 100 is set to the measurement mode by a listening person. When the sound reproducing apparatus 100 is set to the measurement mode, the signal switching section 102 switches a signal path so as to connect the measurement signal generating section 101 to the D/A conversion section 103. Next, the listening person wears a pair of the earphones 110 in the ears (state shown by (a) in FIG. 3). At this time, a content inducing the listening person to wear the earphones 110 may be displayed on, e.g., a display (not shown) of the sound reproducing apparatus 100. After wearing the pair of earphones 110 in the ears, a measurement is started by, for example, the listening person pressing a measurement start button.

Figure 2A:
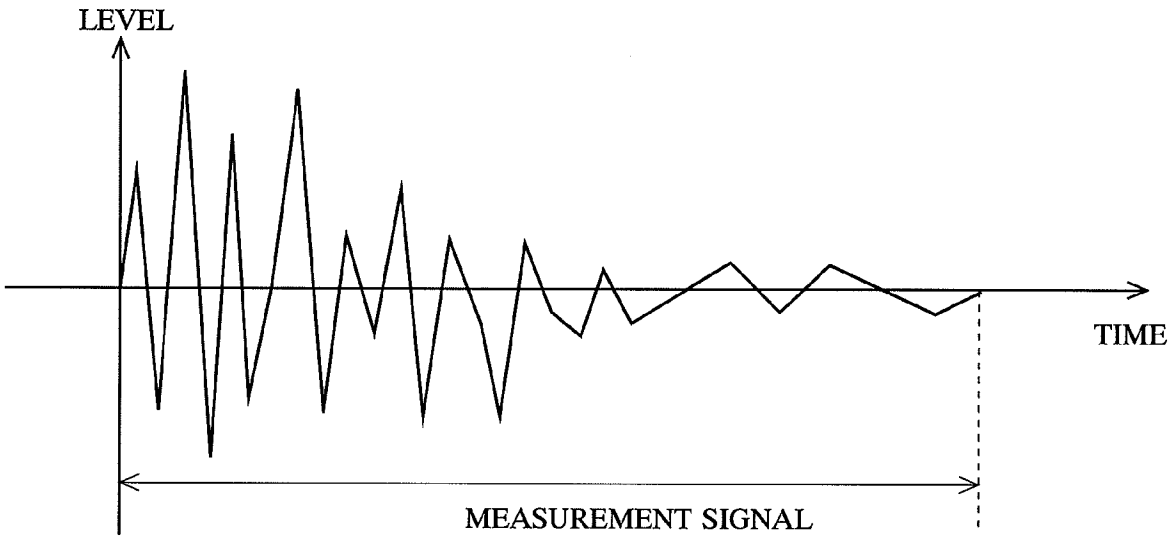
FIG. 2A shows an example of a measurement signal generated by a measurement signal generating section 101.

When the measurement is started, the measurement signal generating section 101 generates a predetermined measurement signal. For the measurement signal, an impulse signal exemplified in FIG. 2A is typically used, though various signals can be used. The measurement signal is outputted from the pair of earphones 110 worn in both ears of the listening person, via the signal switching section 102, the D/A conversion section 103, the amplification section 104, and the distribution section 105. The measurement signal outputted from the earphones 110 passes through the ear canal to arrive at the eardrum, and then is reflected by the eardrum to return to the earphones 110. Structurally; the earphone 110 can be used as a microphone, and measures the measurement signal which has returned after the reflection at the eardrum. The signal (hereinafter, referred to as wearing-state signal) measured by the earphone 110 is outputted via the distribution section 105, the microphone amplification section 106, and the A/D conversion section 107, to the analysis section 108, and is stored.

Next, the listening person removes the pair of earphones 110 from both ears. At this time, a content inducing the listening person to remove the earphones 110 may be displayed on, e.g., the display (not shown) of the sound reproducing apparatus 100. After removing the pair of earphones 110 from both ears, a measurement is started by, for example, the listening person pressing a measurement start button. Note that, both ears of the listening person and the pair of earphones 110 in the state where the earphones 110 are not worn, have a positional relationship in which the earphones 110 do not have contacts with the ears and in which a measurement signal outputted from the earphone 110 can be conducted into the ear canals (state shown by (b) in FIG. 3).

In the above state, the measurement signal is outputted from the pair of earphones 110, passes through the ear canal to be reflected by the eardrum, and returns to the earphones 110. The earphone 110 measures the measurement signal which has returned. The signal (hereinafter, referred to as unwearing-state signal) measured by the earphone 110 is outputted via the distribution section 105, the microphone amplification section 106, and the A/D conversion section 107, to the analysis section 108, and is stored.

Figure 4:
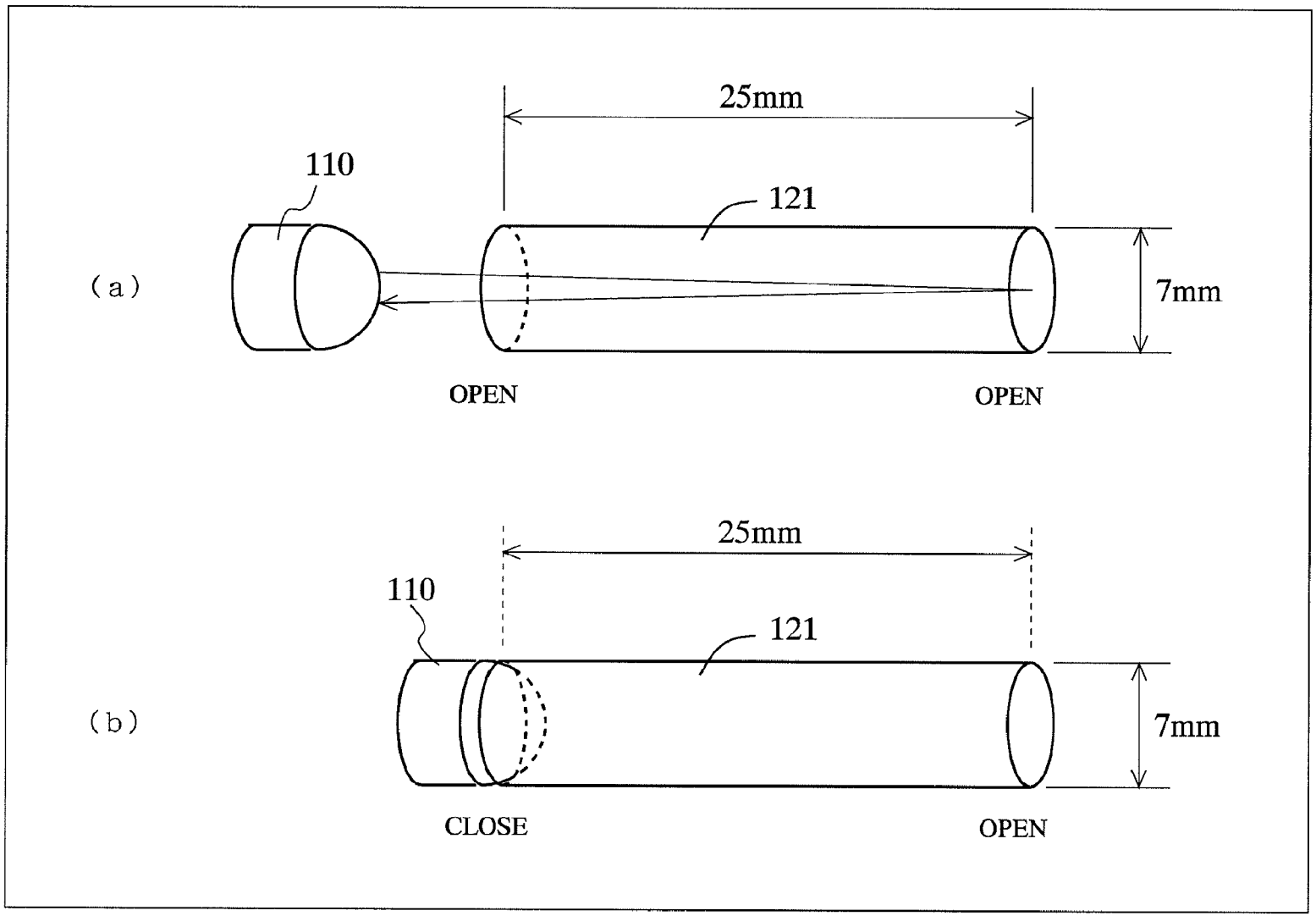
FIG. 4 shows an example of an ear-canal simulator 121.

On the other hand, another method for measuring the unwearing-state signal is a method using an ear-canal simulator which simulates an ear canal. The ear-canal simulator 121 is a measuring instrument having a cylindrical shape with a length of about 25 mm and a diameter of about 7 mm (FIG. 4). A possible configuration of the ear-canal simulator 121 is a configuration ((b) in FIG. 4) where one end thereof is open and the other end is closed, or a configuration where both ends are open ((a) in FIG. 4). When using the ear-canal simulator 121 having the configuration where one end thereof is open and the other end is closed, a measurement is performed in a state where the earphone 110 used for listening does not contact with the ear-canal simulator 121 and where a measurement signal outputted from the earphone 110 can be conducted into the ear-canal simulator 121. On the other hand, when using the ear-canal simulator 121 having the configuration where both ends are open, a measurement is performed in a state where the earphone 110 used for listening is attached to one end of the ear-canal simulator 121. Thus, since the side where the earphones 110 is attached is a closed end and the side opposite thereto is an open end, a characteristic can be measured in the same state as in (a) in FIG. 4 where one end is closed. By using the ear-canal simulator 121, the unwearing-state signal can be measured based on a length (25 mm) and a width (7 mm) of a typical ear canal.

The order in which the wearing-state signal and the unwearing-state signal are measured may be reversed.

Figure 5:
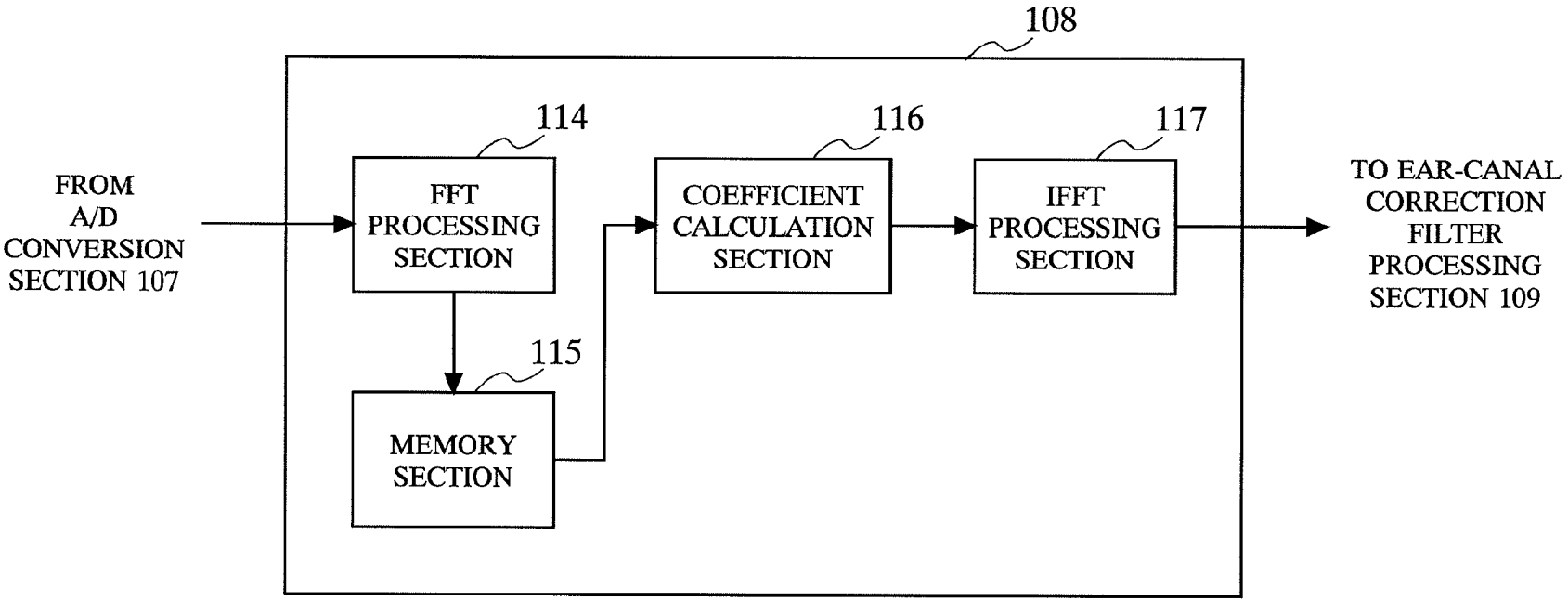
FIG. 5 shows a detailed example of a configuration of an analysis section 108.

FIG. 5 shows a detailed example of a configuration of an analysis section 108. As shown in FIG. 5, the analysis section 108 includes an FFT processing section 114, a memory section 115, a coefficient calculation section 116, and an IFFT processing section 117.

The FFT processing section 114 performs fast Fourier transform (FFT) processing on the wearing-state signal and the unwearing-state signal which are outputted from the A/D conversion section 107, to transform them to signals in frequency domain, respectively. The memory section 115 stores the two signals in frequency domain obtained through the FFT processing. The coefficient calculation section 116 reads out the two signals stored in the memory section 115, and subtracts the unwearing-state signal from the wearing-state signal to obtain a difference therebetween as a coefficient. The coefficient represents a conversion from a state of wearing the earphone 110 to a state (unwearing state) of not wearing the earphone 110.

The coefficient obtained by the coefficient calculation section 116 is data in frequency domain. Therefore, the IFFT processing section 117 performs inverse fast Fourier transform (IFFT) processing on the coefficient in frequency domain obtained by the coefficient calculation section 116 to transform the coefficient to a coefficient in time domain. The coefficient in time domain obtained through the transformation by the IFFT processing section 117 is given as an ear-canal correction filter to the ear-canal correction filter processing section 109.

In the case where the ear-canal correction filter processing section 109 performs convolution processing in frequency domain, the coefficient in frequency domain obtained by the coefficient calculation section 116 may directly be given to the ear-canal correction filter processing section 109 without the IFFT processing section 117 performing IFFT processing. Note that, in this case, an FFT length of the FFT processing section 114 needs to be the same as an FFT length used in the ear-canal correction filter processing section 109.

Figure 2B:
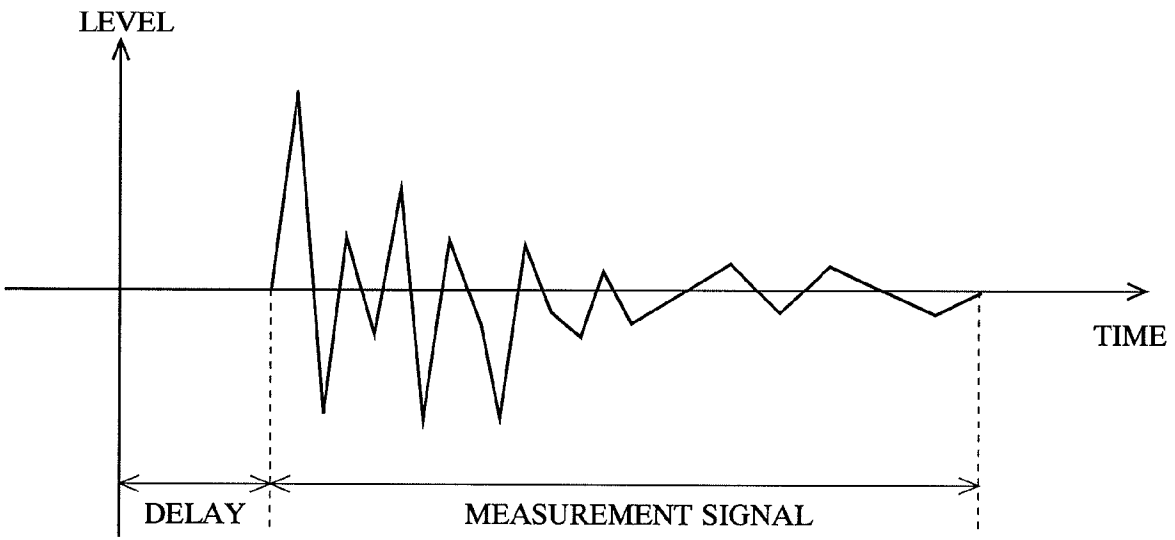
FIG. 2B shows another example of the measurement signal generated by the measurement signal generating section 101.

In addition, the FFT processing section 114 may perform FFT processing immediately after a measurement is started (the measurement signal is generated), or may exclude the beginning part of the measurement signal (cause delay) to perform FFT processing, as shown in FIG. 2B.

2. Reproduction Mode

After giving the ear-canal correction filter to the ear-canal correction filter processing section 109 in the measurement mode, a sound source signal is reproduced as follows.

The sound reproducing apparatus 100 is set to the reproduction mode by the listening person. When the sound reproducing apparatus 100 is set to the reproduction mode, the signal switching section 102 switches a signal path so as to connect the ear-canal correction filter processing section 109 to the D/A conversion section 103. Next, the listening person wears the pair of earphones 110 in the ears, and then a measurement is started by, for example, the listening person pressing a measurement start button.

When a reproduction of the sound source signal is started, the sound source signal is inputted to the ear-canal correction filter processing section 109, and the ear-canal correction filter processing section 109 convolves the sound source signal with the ear-canal correction filter given by the analysis section 108. By performing the convolution processing, an acoustic characteristic equivalent to that in the case of not wearing the earphone 110 (where the ear canal is not blocked) can be obtained, even when wearing the earphone 110. The convolved sound source signal is outputted from the pair of earphones 110 worn in the ears of the listening person, via the signal switching section 102, the D/A conversion section 103, the amplification section 104, and the distribution section 105.

As described above, the sound reproducing apparatus 100 according to the first embodiment of the present invention measures a characteristic of an ear canal of an individual by using the earphone 110 used for listening, and thereby can obtain an optimum ear-canal correction filter. Thus, a listening state which is suitable for the earphone 110 for listening and is equivalent to a listening state in the case where the ear canal is not blocked, can be realized, even when wearing the earphone 110 in the ear.

In the first embodiment, a configuration including the microphone amplification section 106 and the A/D conversion section 107 is used. However, in the case where the sound reproducing apparatus 100 has an ANC (active noise cancel) function, the ANC function can used as both the microphone amplification section 106 and the A/D conversion section 107.

Second Embodiment

Figure 6:
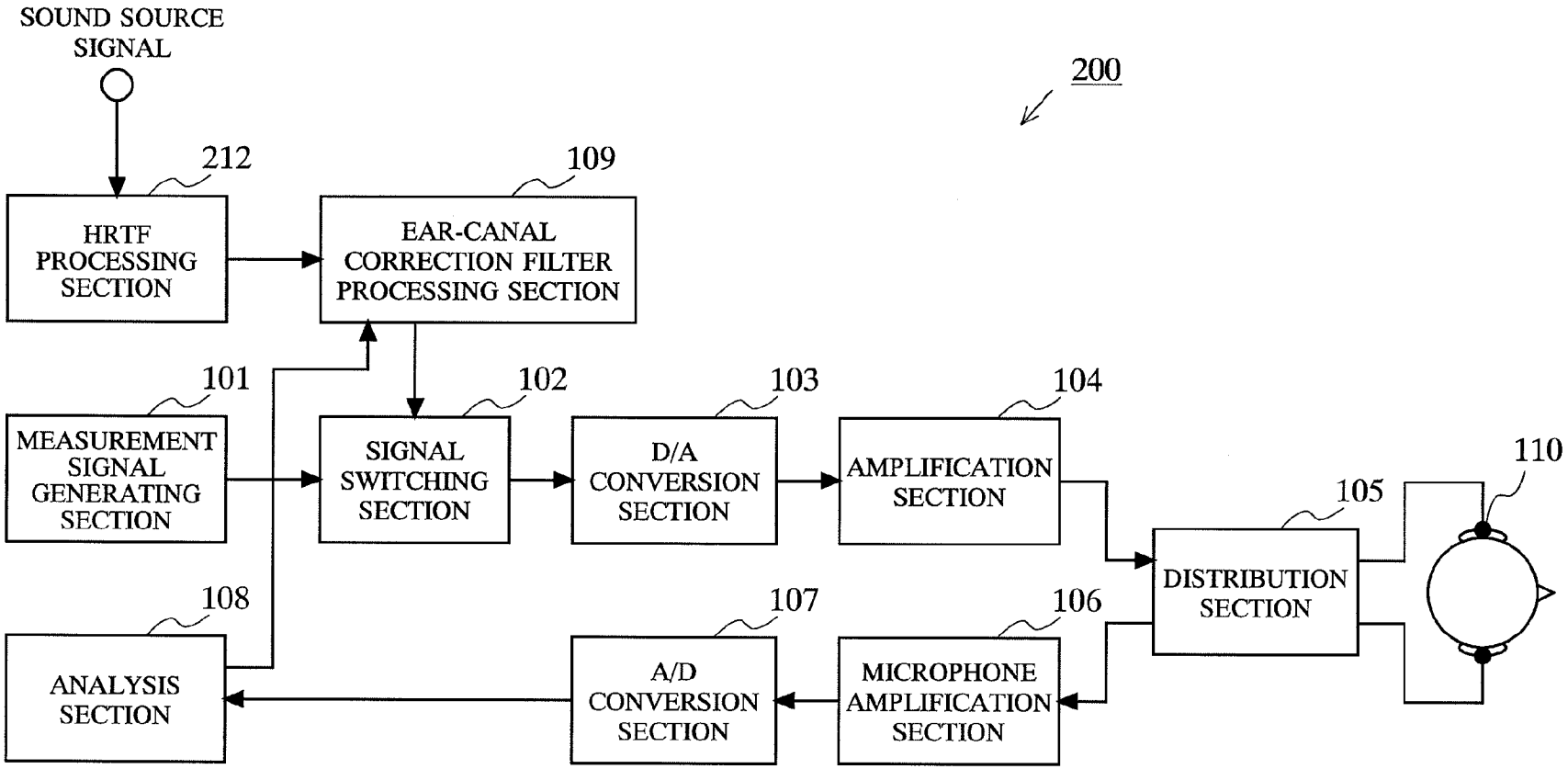
FIG. 6 shows a configuration of a sound reproducing apparatus 200 according to a second embodiment of the present invention.

FIG. 6 shows a configuration of a sound reproducing apparatus 200 according to a second embodiment of the present invention. As shown in FIG. 6, the sound reproducing apparatus 200 includes the measurement signal generating section 101, the signal processing section 111, the analysis section 108, the ear-canal correction filter processing section 109, the earphone 110, and an HRTF processing section 212.

As shown in FIG. 6, the sound reproducing apparatus 200 according to the second embodiment is different from the sound reproducing apparatus 100 according to the first embodiment, with respect to the HRTF processing section 212. Hereinafter, the sound reproducing apparatus 200 will be described focusing on the HRTF processing section 212 which is the difference. The same components as those of the sound reproducing apparatus 100 are denoted by the same reference numerals and description thereof is omitted.

When a reproduction of the sound source signal is started in the reproduction mode, the sound signal is inputted to the HRTF processing section 212. The HRTF processing section 212 convolves the sound source signal with a head-related transfer function (HRTF) which is set in advance. By using the head-related transfer function, a sound image which makes the listening person feel as if listening through a speaker can be listened to even if using the earphone 110. The sound source signal convolved with the head-related transfer function is inputted to the ear-canal correction filter processing section 109 from the HRTF processing section 212, and then the ear-canal correction filter processing section 109 convolves the sound source signal with the ear-canal correction filter given by the analysis section 108.

As described above, the sound reproducing apparatus 200 according to the second embodiment of the present invention enhances accuracy of control of three-dimensional sound-field reproduction, and can realize an out-of-head sound localization in a more natural state, in addition to providing the effects of the first embodiment.

Note that, the order in which the ear-canal correction filter processing section 109 and the HRTF processing section 212 are arranged may be reversed.

Third Embodiment

Figure 7:
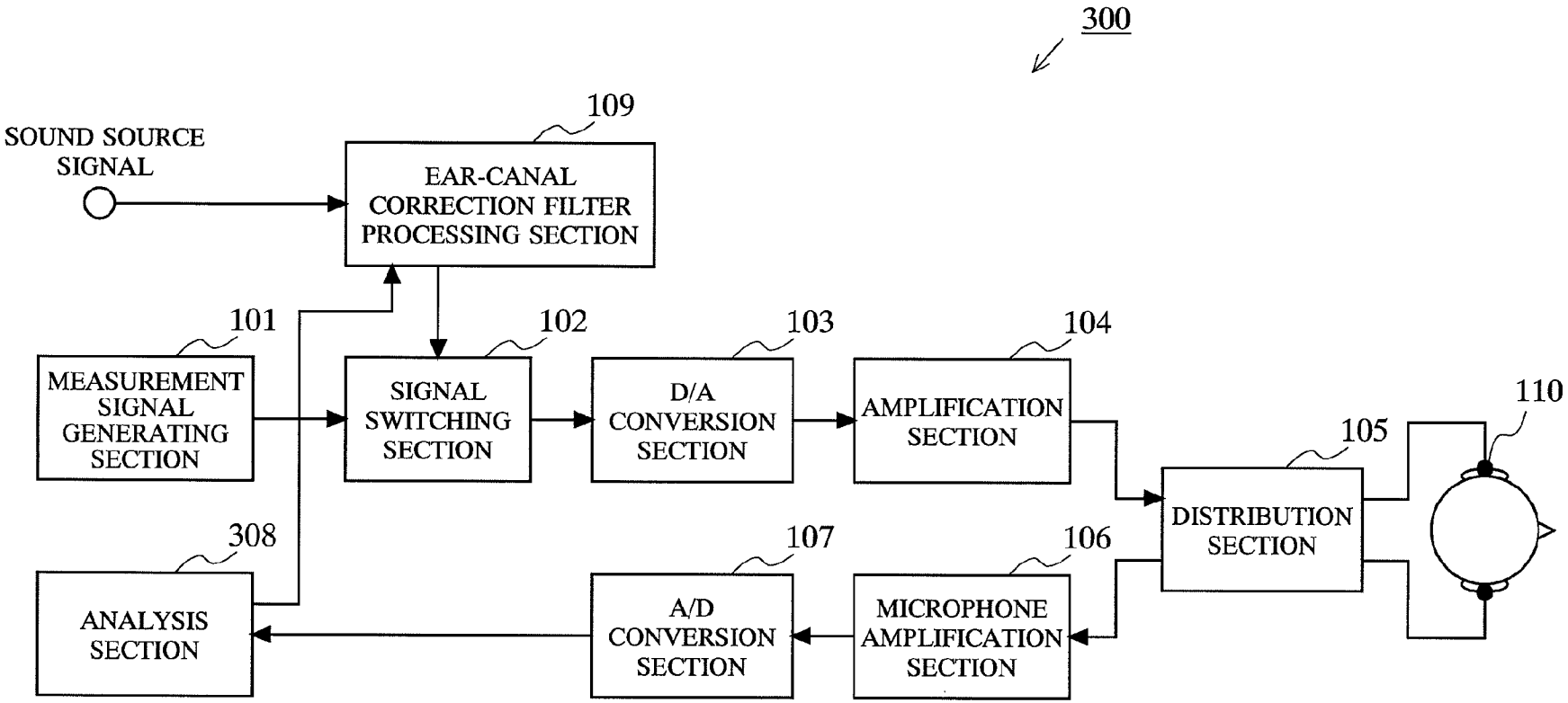
FIG. 7 shows a configuration of a sound reproducing apparatus 300 according to a third embodiment of the present invention.
Figure 8:
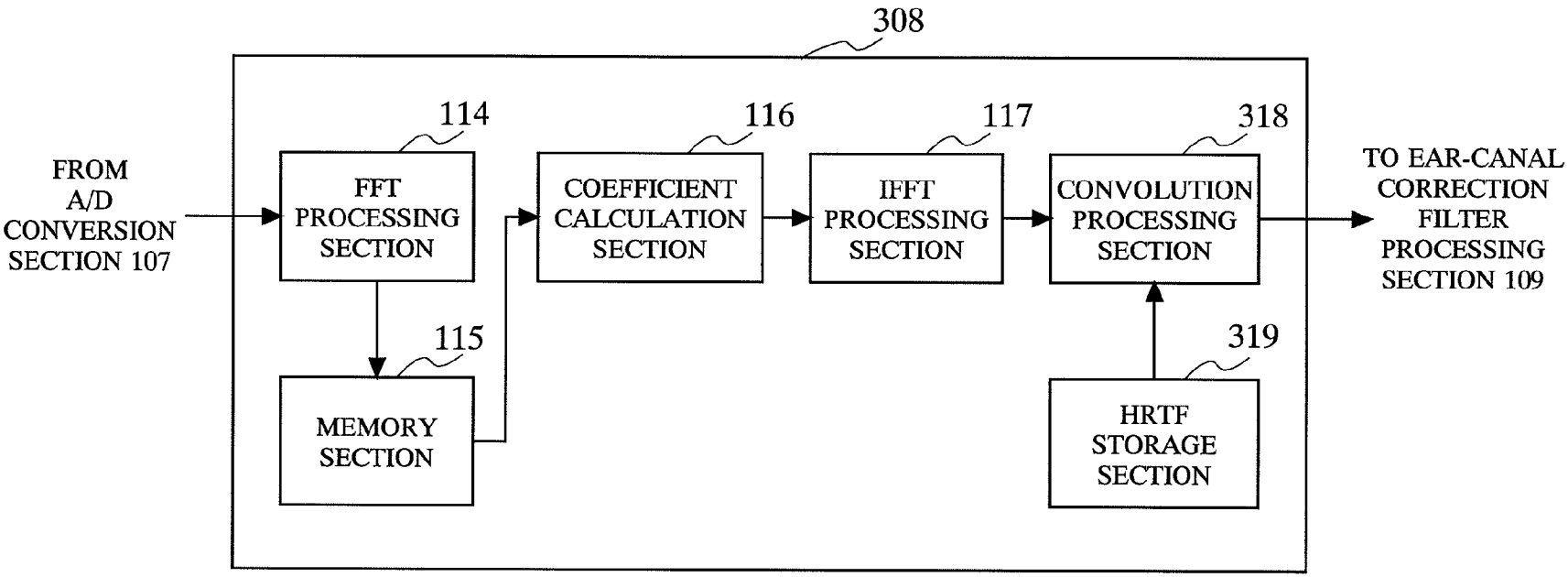
FIG. 8 shows a detailed example of a configuration of an analysis section 308.

FIG. 7 shows a configuration of a sound reproducing apparatus 300 according to a third embodiment of the present invention. As shown in FIG. 7, the sound reproducing apparatus 300 includes the measurement signal generating section 101, the signal processing section 111, an analysis section 308, the ear-canal correction filter processing section 109, and the earphone 110. FIG. 8 shows a detailed example of a configuration of the analysis section 308. As shown in FIG. 8, the analysis section 308 includes the FFT processing section 114, the memory section 115, the coefficient calculation section 116, the IFFT processing section 117, a convolution processing section 318, and an HRTF storage section 319.

The sound reproducing apparatus 300 according to the third embodiment shown in FIG. 7 and FIG. 8 is different from the sound reproducing apparatus 100 according to the first embodiment, with respect to the convolution processing section 318 and the HRTF storage section 319. Hereinafter, the sound reproducing apparatus 300 will be described focusing on the convolution processing section 318 and the HRTF storage section 319 which are the difference. The same components as those of the sound reproducing apparatus 100 are denoted by the same reference numerals and description thereof is omitted.

A filter in time domain outputted from the IFFT processing section 117 is inputted to the convolution processing section 318. The HRTF storage section 319 stores in advance a filter coefficient of a head-related transfer function corresponding to a direction in which localization should be performed. The convolution processing section 318 convolves the ear-canal correction filter inputted from the IFFT processing section 117 with the filter coefficient of the head-related transfer function stored in the HRTF storage section 319. The filter convolved by the convolution processing section 318 is given, as an ear-canal correction filter which includes a head-related transfer function characteristic, to the ear-canal correction filter processing section 109.

In the case where the ear-canal correction filter processing section 109 performs convolution processing in frequency domain, the coefficient in frequency domain obtained by the coefficient calculation section 116 may be convolved with the filter coefficient of the head-related transfer function stored in the HRTF storage section 319 without the IFFT processing section 117 performing IFFT processing. Note that, in this case, an FFT length of the FFT processing section 114 needs to be the same as an FFT length used in the ear-canal correction filter processing section 109.

As described above, the sound reproducing apparatus 300 according to the third embodiment of the present invention enhances accuracy of control of three-dimensional sound-field reproduction, and can realize an out-of-head sound localization in a more natural state, in addition to providing the effects of the first embodiment.

Moreover, in the sound reproducing apparatus 300 according to the third embodiment of the present invention, since sound localization processing using the head-related transfer function is performed in the analysis section 308, an amount of operation performed on the sound source signal in the reproduction mode can be reduced in comparison with the sound reproducing apparatus 200 according to the second embodiment.

Fourth Embodiment

Figure 9:
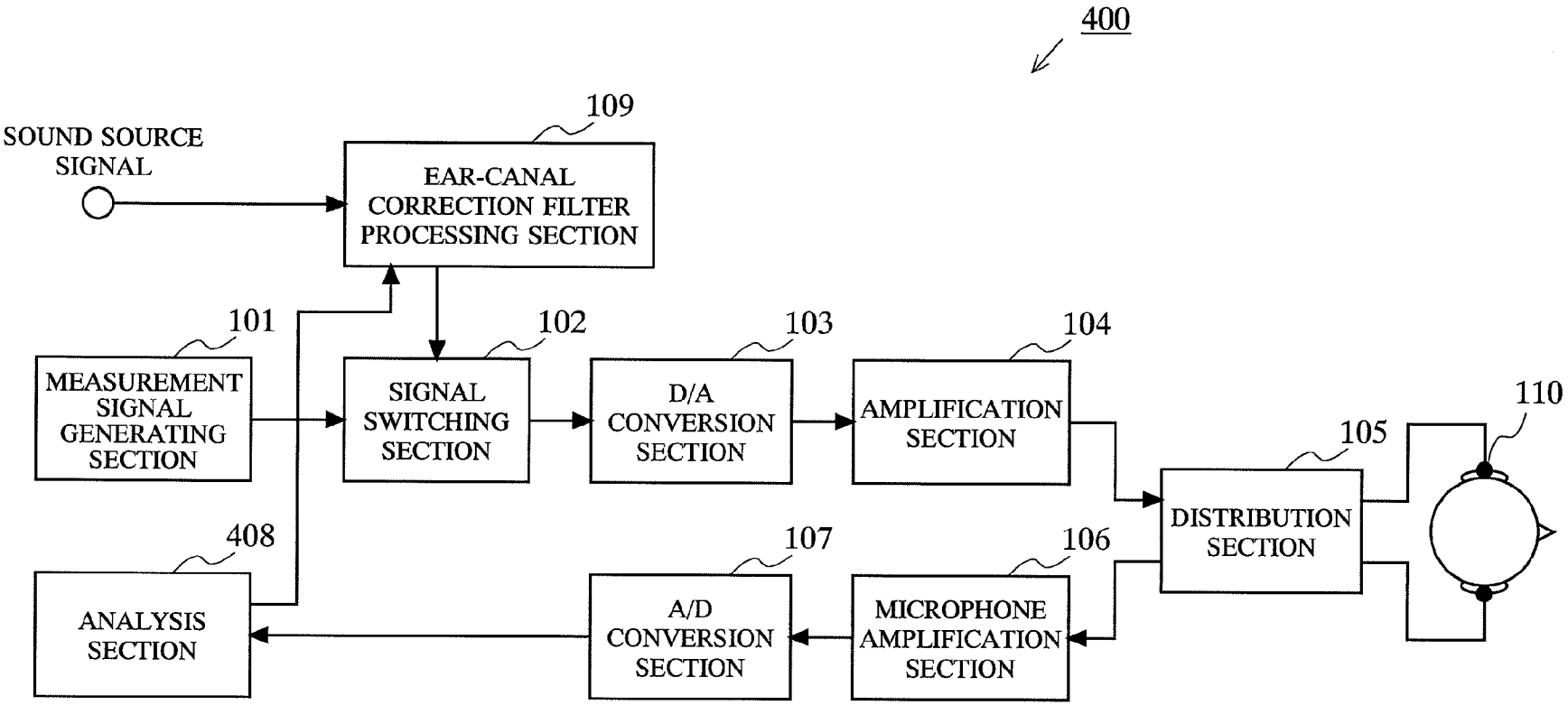
FIG. 9 shows a configuration of a sound reproducing apparatus 400 according to a fourth embodiment of the present invention.

FIG. 9 shows a configuration of a sound reproducing apparatus 400 according to a fourth embodiment of the present invention. As shown in FIG. 9, the sound reproducing apparatus 400 includes the measurement signal generating section 101, the signal processing section 111, an analysis section 408, the ear-canal correction filter processing section 109, and the earphone 110.

The sound reproducing apparatus 400 according to the fourth embodiment shown in FIG. 9 is different from the sound reproducing apparatus 100 according to the first embodiment, with respect to a configuration of the analysis section 408. Hereinafter, the sound reproducing apparatus 400 will be described focusing on the analysis section 408 which is the difference. The same components as those of the sound reproducing apparatus 100 are denoted by the same reference numerals and description thereof is omitted.

The sound reproducing apparatus 400 according to the fourth embodiment measures only the wearing-state signal in the measurement mode. The analysis section 408 obtains an ear-canal correction filter based on the wearing-state signal by the following process.

Figure 10:
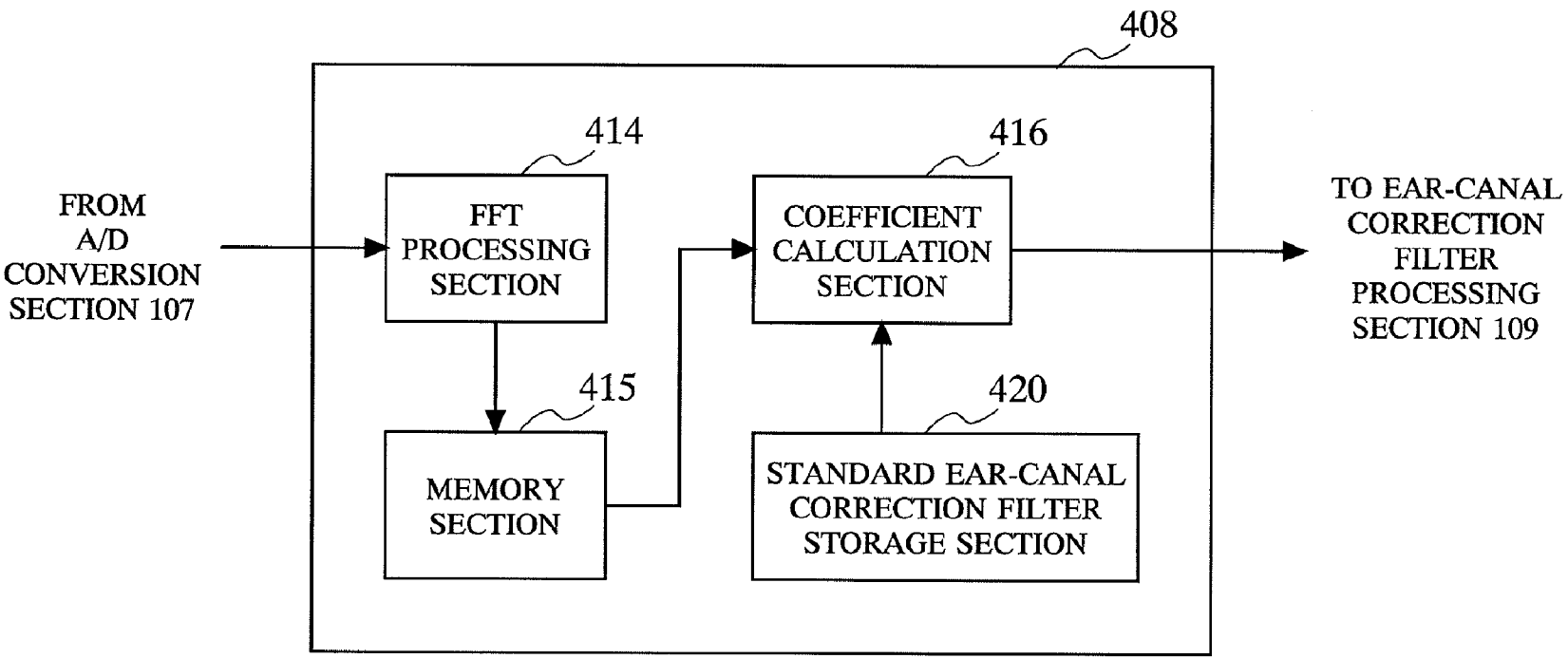
FIG. 10 shows a detailed example of a configuration of an analysis section 408.

FIG. 10 shows a detailed example of the configuration of the analysis section 408. As shown in FIG. 10, the analysis section 408 includes an FFT processing section 414, a memory section 415, a coefficient calculation section 416, and a standard ear-canal correction filter storage section 420.

The FFT processing section 414 performs fast Fourier transform processing on the wearing-state signal outputted from the A/D conversion section 107, to transform the wearing-state signal to a signal in frequency domain. The memory section 415 stores the wearing-state signal in frequency domain obtained through the FFT processing. The coefficient calculation section 416 reads out the wearing-state signal stored in the memory section 415, and analyzes the frequency component of the wearing-state signal to obtain frequencies of a peak and a dip.

The frequencies of the peak and the dip are resonance frequencies of the ear canal. The resonance frequencies can be specified from the wearing-state signal measured in a state where the earphone 110 is worn in the ear. Note that, among resonance frequencies, a range of frequencies causing high resonances which require ear canal correction is from 2 kHz to 10 kHz, with a length of the ear canal taken into consideration. Therefore, upon the calculation of a peak and a dip, an amount of operation can be reduced by calculating only those within the above range of frequencies.

The standard ear-canal correction filter storage section 420 stores parameters of the standard ear-canal filter and the standard ear-canal correction filter which are measured in a state where a particular earphone is attached to an ear-canal simulator which simulates an ear canal of a standard person. Each of the standard ear-canal filter and the standard ear-canal correction filter is formed by an IIR filter. The IIR filter includes a center frequency F, a gain G, and a transition width Q as parameters. The coefficient calculation section 416 reads out the parameters of the standard ear-canal filter from the standard ear-canal correction filter storage section 420, after calculating the frequencies of the peak and the dip of a measured frequency characteristic. The coefficient calculation section 416 corrects the center frequencies F to the corresponding frequencies of the peak and the dip.

Figure 11:
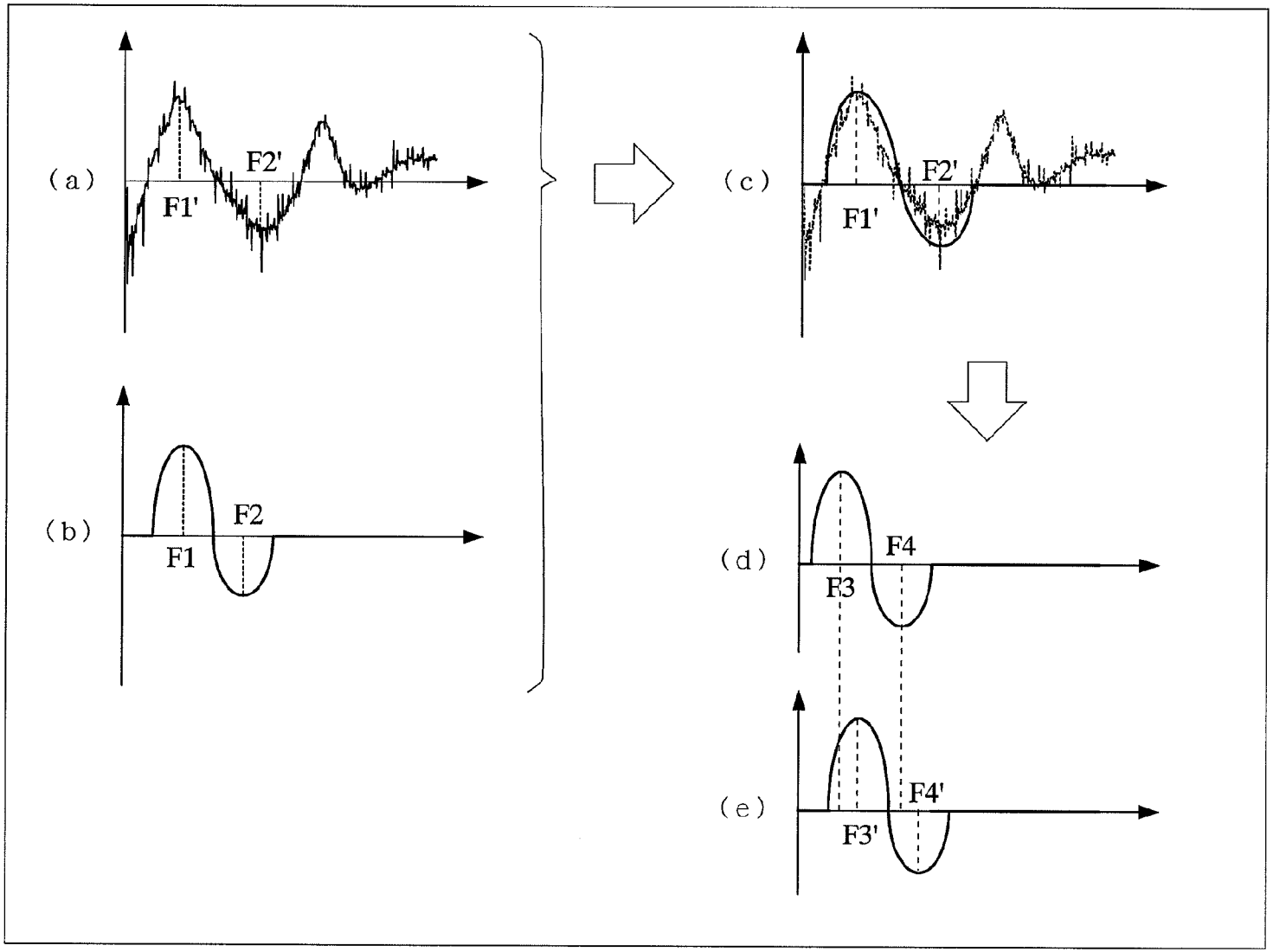
FIG. 11 shows an example of a correction of a filter performed by a coefficient calculation section 416.

FIG. 11 shows an example of a correction (correction of the center frequency F) of a filter performed by the coefficient calculation section 416. (a) in FIG. 11 shows a frequency characteristic of the wearing-state signal, and (b) in FIG. 11 shows a frequency characteristic of the standard ear-canal filter. It is obvious from the frequency characteristic of the wearing-state signal that a first peak frequency F1' corresponds to a center frequency F1 of the standard ear-canal filter, and that a first dip frequency F2' corresponds to a center frequency F2 of the standard ear-canal filter. The coefficient calculation section 416 calculates a difference $F1_{diff}$ (=F1−F1') and a difference $F2_{diff}$ (=F2−F2') for correcting the center frequencies F1 and F2 of the standard ear-canal filter to the frequencies F1' and F2', respectively (see (c) in FIG. 11). Next, the coefficient calculation section 416 reads out the standard ear-canal correction filter from the standard ear-canal correction filter storage section 420. In the case where the center frequency F1 of the standard ear canal filter corresponds to a center frequency F3 of the standard ear-canal correction filter, and where the center frequency F2 of the standard ear canal filter corresponds to a center frequency F4 of the standard ear-canal correction filter ((d) in FIG. 11), the coefficient calculation section 416 corrects the center frequency F3 of the standard ear-canal correction filter by the difference $F1_{diff}$ to calculate a frequency F3', and corrects the center frequency F4 by the difference $F2_{diff}$ to calculate a frequency F4' ((e) in FIG. 11). With the above processing, correction of the ear-canal correction filter is completed.

After the correction of the standard ear-canal correction filter is completed, the coefficient calculation section 416 converts the standard ear-canal correction filter from a filter for an IIR filter to a filter for an FIR filter, and gives the standard ear-canal correction filter to the ear-canal correction filter processing section 109. In the case where the ear-canal correction filter is formed by an IIR filter, an IIR filter coefficient may be calculated from parameters of the IIR filter and may be given to the ear-canal correction filter processing section 109.

As described above, the sound reproducing apparatus 400 according to the fourth embodiment of the present invention corrects a peak frequency and a dip frequency of the standard ear-canal correction filter based on a measured wearing-state signal. Thus, the effects of the first embodiment can be realized with a small number of measurements. The correction method of the fourth embodiment can be applied to the second and third embodiments in a similar manner.

Fifth Embodiment

Figure 12:
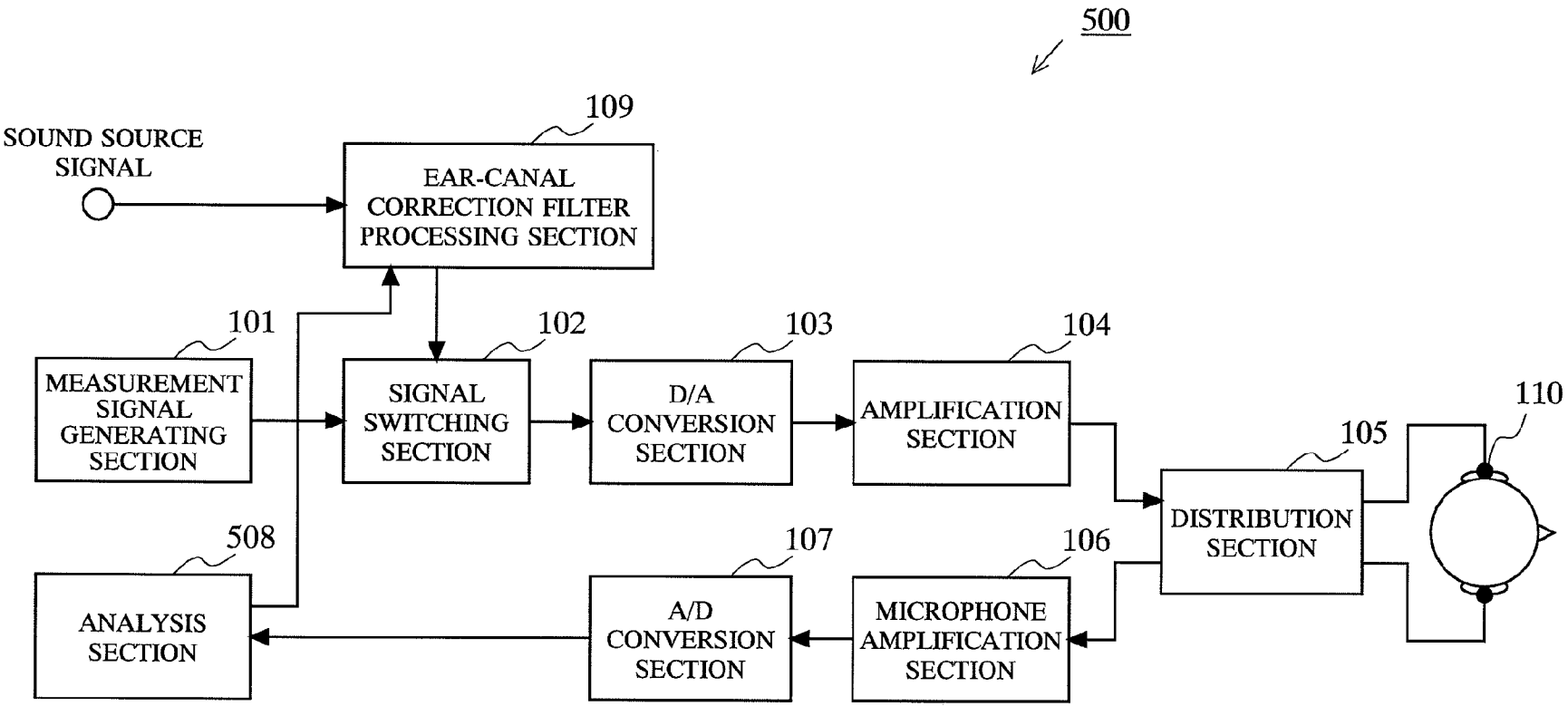
FIG. 12 shows a configuration of a sound reproducing apparatus 500 according to a fifth embodiment of the present invention.
Figure 13:
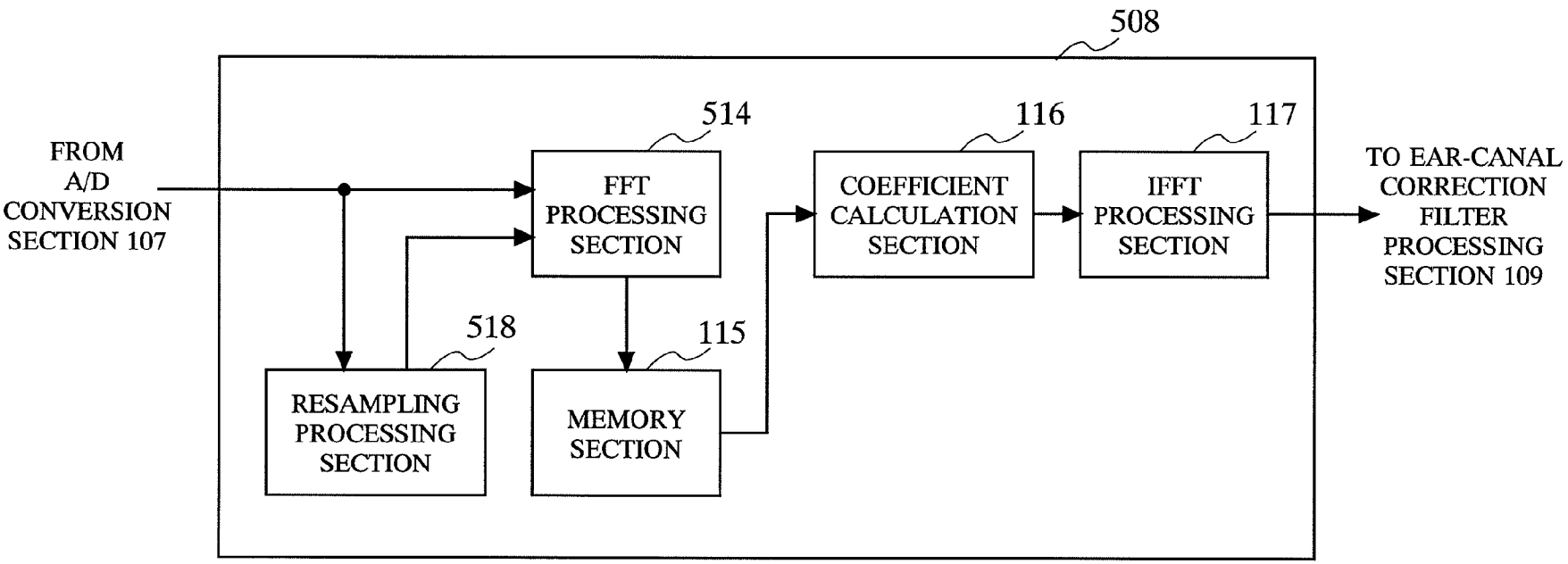
FIG. 13 shows a detailed example of a configuration of an analysis section 508.

FIG. 12 shows a configuration of a sound reproducing apparatus 500 according to a fifth embodiment of the present invention. As shown in FIG. 12, the sound reproducing apparatus 500 includes the measurement signal generating section 101, the signal processing section 111, the analysis section 408, the ear-canal correction filter processing section 109, and the earphone 110. FIG. 13 shows a detailed example of a configuration of an analysis section 508. As shown in FIG. 13, the analysis section 508 includes a resampling processing section 518, an FFT processing section 514, the memory section 115, the coefficient calculation section 116, and the IFFT processing section 117.

The sound reproducing apparatus 500 according to the fifth embodiment shown in FIG. 12 and FIG. 13 is different from the sound reproducing apparatus 100 according to the first embodiment, with respect to the resampling processing section 518 and the FFT processing section 514. Hereinafter, the sound reproducing apparatus 500 will be described focusing on the resampling processing section 518 and the FFT processing section 514 which are the difference. The same components as those of the sound reproducing apparatus 100 are denoted by the same reference numerals and description thereof is omitted.

The sound reproducing apparatus 500 according to the fourth embodiment measures only the wearing-state signal in the measurement mode. The analysis section 508 obtains an ear-canal correction filter based on the wearing-state signal by the following process.

The resampling processing section 518 performs resampling processing on a wearing-state signal outputted from the A/D conversion section 107. For example, when a sampling frequency for the wearing-state signal is 48 kHz, the same processing as conversion to 24 kHz is performed. This processing means that, since a resonance frequency of a resonance characteristic in the case where one end is closed is equal to ½ of a resonance frequency of a resonance characteristic in the case where both ends are closed, a frequency characteristic in the case where one end is closed is calculated in a simulated manner by converting, to ½, a frequency characteristic measured in a state where both ends are closed.

Figure 14:
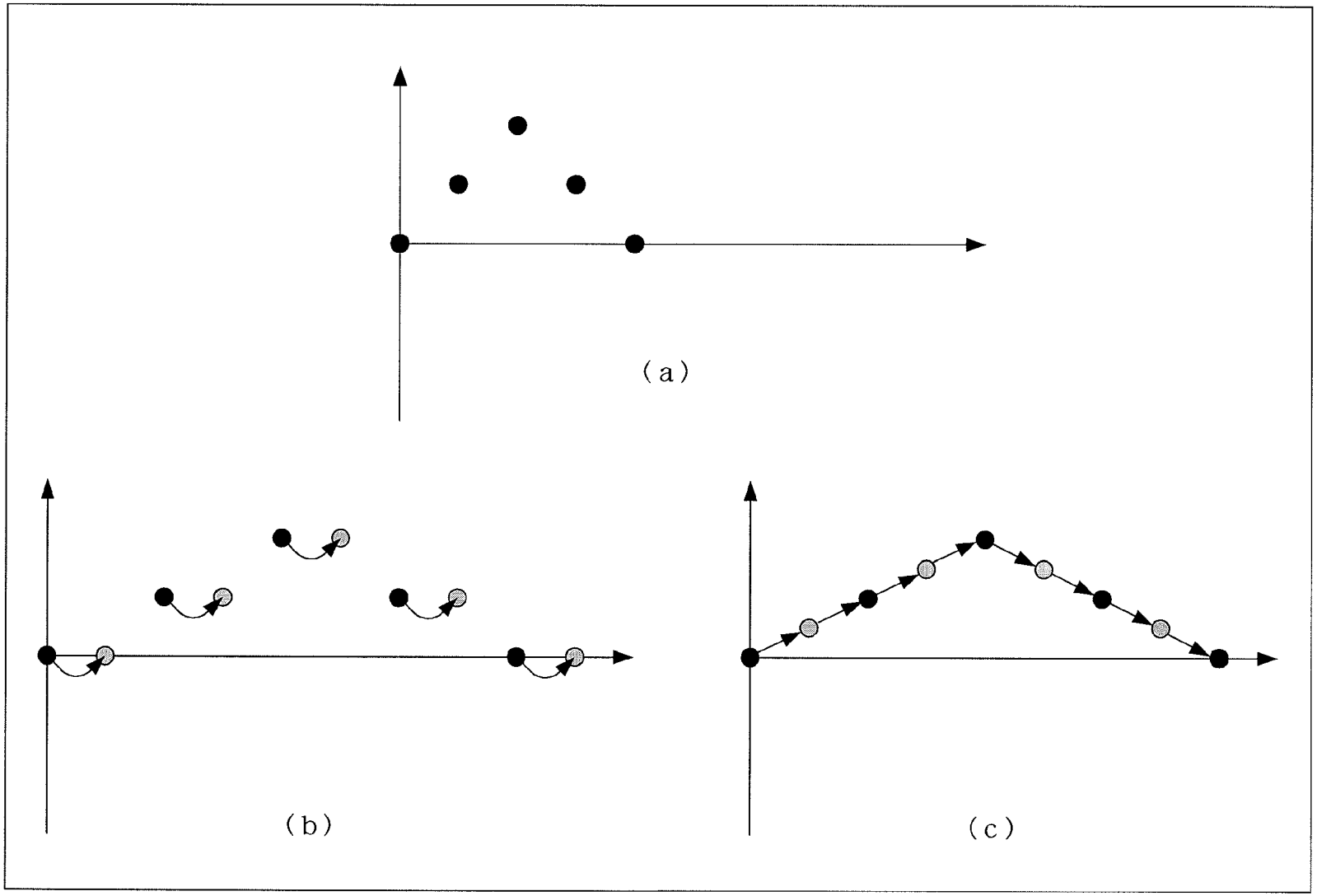
FIG. 14 shows resampling processing performed by a resampling processing section 518.

FIG. 14 shows a simplified method of resampling processing performed by the resampling processing section 518. (a) in FIG. 14 shows an example of a wearing-state signal outputted from the A/D conversion section 107. In (b) in FIG. 14, a frequency characteristic is converted to ½ by a method in which the same values as those of the wearing-state signal are interpolated one time. In (c) in FIG. 14, a frequency characteristic is converted to ½ by a method in which a central value between adjacent values of the wearing-state signal is linearly interpolated. Other than the above methods, an interpolation method such as a spline interpolation may be used. Alternatively, other resampling methods may be used.

The FFT processing section 514 performs fast Fourier transform (FFT) processing on the wearing-state signal outputted from the A/D conversion section 107, and on the unwearing-state simulation signal on which resampling processing has been performed by the resampling processing section 518, to transform them to signals in frequency domain, respectively. The memory section 115 stores the two signals in frequency domain obtained through the FFT processing. The coefficient calculation section 116 reads out the two signals stored in the memory section 115, and subtracts the unwearing-state simulation signal from the wearing-state signal to obtain a difference therebetween as a coefficient. The coefficient represents a conversion from a state of wearing the earphone 110 to a state (unwearing state) of not wearing the earphone 110.

As described above, the sound reproducing apparatus 500 according to the fifth embodiment of the present invention performs resampling processing on the wearing-state signal to obtain an unwearing-state simulation signal. Thus, the effects of the first embodiment can be realized with a small number of measurements. The correction method of the fifth embodiment can be applied to the second and third embodiments in a similar manner.

Figure 15:
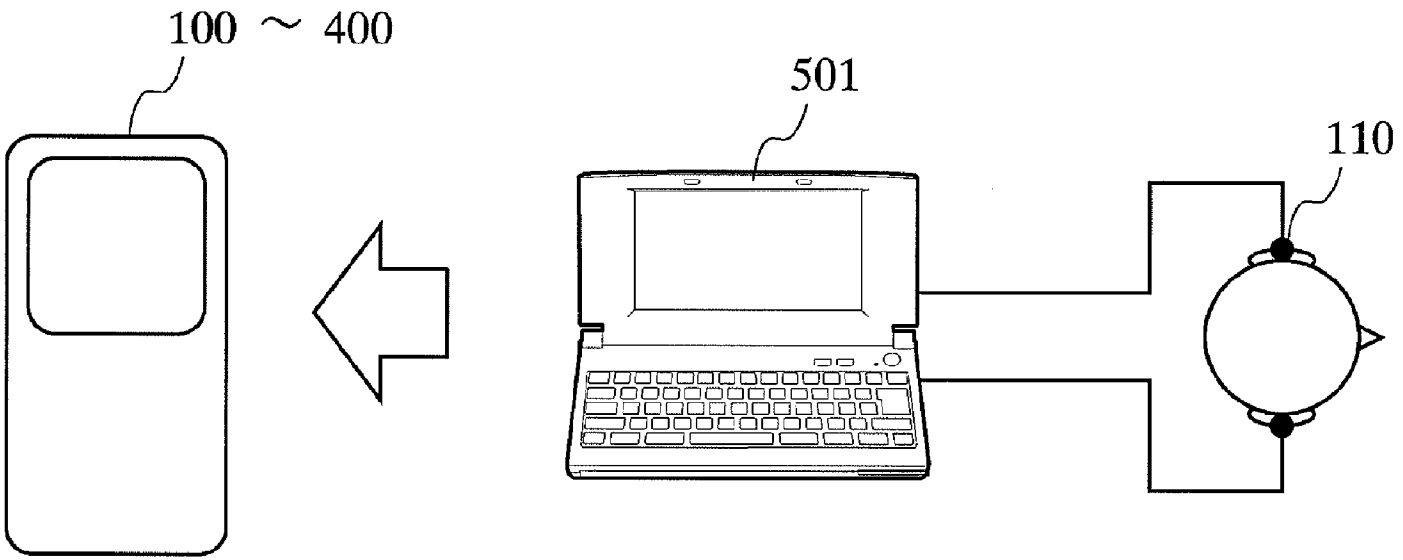
FIG. 15 shows a typical example of an implementation of the first to fifth embodiments of the present invention.
Figure 16:
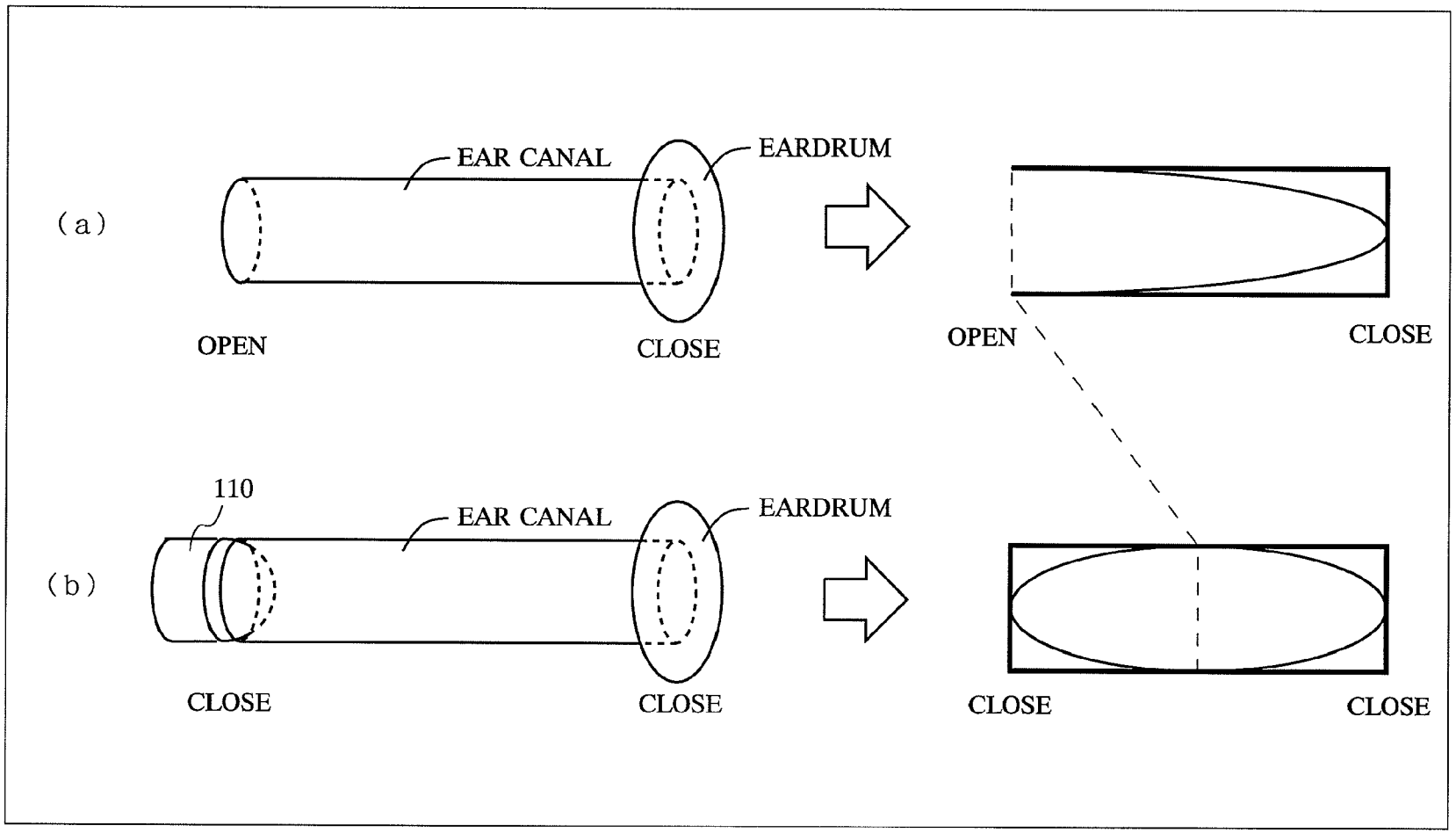
FIG. 16 shows a relation between a resonance frequency, and a state where an ear canal is open or a state where an ear canal is closed.
Figure 17:
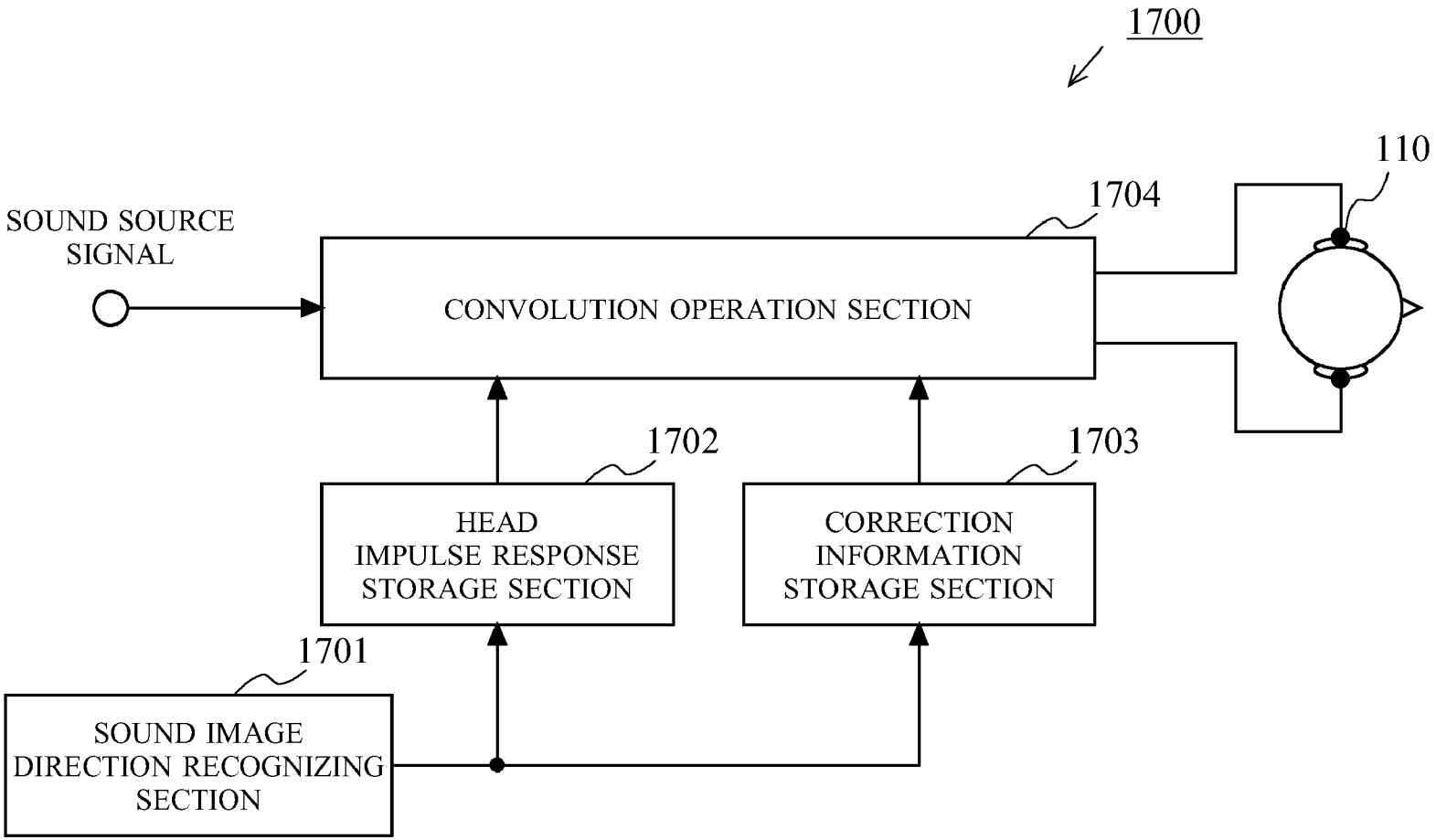
FIG. 17 PRIOR ART
FIG. 17 shows an example of a configuration of a conventional sound reproducing apparatus 1700.

Processings executed in the measurement modes described in the first to fifth embodiments is typically executed via a personal computer (PC) 501 as shown in FIG. 15. The PC 501 includes software for performing the processings executed in the measurement mode. By executing the software, predetermined processings are sequentially executed, the resultant ear-canal correction filters are transferred to the sound reproducing apparatuses 100 to 500 via a memory, a radio device, or the like included in the PC 501.

Thus, if the processings in the measurement modes can be executed by using the PC 501, there is no need for the sound reproducing apparatuses 100 to 500 to have functions of executing the processing in the measurement modes.

INDUSTRIAL APPLICABILITY

A sound reproducing apparatus of the present invention is applicable to a sound reproducing apparatus or the like which performs sound reproduction by using an in-ear earphone, and particularly, is useful, e.g., when it is desired to realize a listening state equivalent to that in the case where the ear canal is not blocked, even when wearing the earphone in the ear.

The invention claimed is:

1. A sound reproducing apparatus reproducing sound by using an in-ear earphone, the sound reproducing apparatus comprising:

a measurement signal generating section for generating a measurement signal;

a signal processing section for, in a state where the in-ear earphone is worn in an ear of a listening person, outputting the measurement signal from the in-ear earphone to an ear canal of the listening person by using a speaker function of the in-ear earphone, and measuring, with the in-ear earphone, the signal reflected by an eardrum of the listening person by using a microphone function of the in-ear earphone;

an analysis section for storing a standard ear-canal correction filter measured in advance by using an ear-canal simulator which simulates an ear-canal characteristic, and for obtaining an ear-canal correction filter by analyzing the signal measured by the signal processing section and correcting the standard ear-canal correction filter; and an ear-canal correction filter processing section for, when sound is reproduced from a sound source signal, convolving the sound source signal with the ear-canal correction filter obtained by the analysis section.

2. The sound reproducing apparatus according to claim 1, wherein the standard ear-canal correction filter is stored as a parameter of an IIR filter.

3. The sound reproducing apparatus according to claim 1, wherein the analysis section performs processing on a characteristic obtained through the measurement, only within a range of frequencies causing a change in a characteristic of the ear canal.

4. The sound reproducing apparatus according to claim 1, wherein a range of frequencies causing a change in a characteristic of the ear canal is from 2 kHz to 10 kHz.

5. The sound reproducing apparatus according to claim 1, further comprising an HRTF processing section, which is provided at a preceding stage of the ear-canal correction filter processing section, for convolving the sound source signal with a predetermined head-related transfer function.

6. The sound reproducing apparatus according to claim 1, further comprising an HRTF processing section, which is provided at a subsequent stage of the ear-canal correction filter processing section, for convolving the sound source signal convolved with the ear-canal correction filter with a predetermined head-related transfer function.

7. The sound reproducing apparatus according to claim 1, wherein the analysis section stores a predetermined head-related transfer function, and obtains the ear-canal correction filter convolved with the head-related transfer function.

8. A sound reproducing apparatus reproducing sound by using an in-ear earphone, the sound reproducing apparatus comprising:

a measurement signal generating section for generating a measurement signal;

a signal processing section for, both in a state where the in-ear earphone is worn in an ear of a listening person and in a state where the in-ear earphone is not worn in the ear of the listening person, outputting the measurement signals from the in-ear earphone to an ear canal of the listening person by using a speaker function of the in-ear earphone, and measuring, with the in-ear earphone, the signals reflected by an eardrum of the listening person by using a microphone function of the in-ear earphone;

an analysis section for analyzing the signals measured in the two states by the signal processing section and obtaining an ear-canal correction filter; and an ear-canal correction filter processing section for, when sound is reproduced from a sound source signal, convolving the sound source signal with the ear-canal correction filter obtained by the analysis section.

9. The sound reproducing apparatus according to claim 1, wherein the measurement signal is an impulse signal.

10. The sound reproducing apparatus according to claim 8, further comprising an HRTF processing section, which is provided at a preceding stage of the ear-canal correction filter processing section, for convolving the sound source signal with a predetermined head-related transfer function.

11. The sound reproducing apparatus according to claim 8, further comprising an HRTF processing section, which is provided in a subsequent stage of the ear-canal correction filter processing section, for convolving the sound source signal convolved with the ear-canal correction filter with a predetermined head-related transfer function.

12. The sound reproducing apparatus according to claim 8, wherein the analysis section stores a predetermined head-related transfer function, and obtains the ear-canal correction filter convolved with the head-related transfer function.

13. A sound reproducing apparatus reproducing sound by using an in-ear earphone, the sound reproducing apparatus comprising:

a measurement signal generating section for generating a measurement signal;

a signal processing section for, in a state where the in-ear earphone is worn in an ear of a listening person, outputting the measurement signal from the in-ear earphone to an ear canal of the listening person by using a speaker function of the in-ear earphone, and measuring, with the in-ear earphone, the signal reflected by an eardrum of the listening person by using a microphone function of the in-ear earphone, and for, in a state where the in-ear earphone is attached to an ear-canal simulator which simulates an ear-canal characteristic, outputting the measurement signal from the in-ear earphone by using a speaker function of the in-ear earphone, and measuring the signal with the in-ear earphone by using the microphone function thereof, thereby the signal processing section measuring a characteristic in a state where the in-ear earphone is not worn in the ear of the listening person;

an analysis section for analyzing the signals measured in the two states by the signal processing section and obtaining an ear-canal correction filter; and an ear-canal correction filter processing section for, when sound is reproduced from a sound source signal, convolving the sound source signal with the ear-canal correction filter obtained by the analysis section.

14. The sound reproducing apparatus according to claim 13, further comprising an HRTF processing section, which is provided at a preceding stage of the ear-canal correction filter processing section, for convolving the sound source signal with a predetermined head-related transfer function.

15. The sound reproducing apparatus according to claim 13, further comprising an HRTF processing section, which is provided in a subsequent stage of the ear-canal correction filter processing section, for convolving the sound source signal convolved with the ear-canal correction filter with a predetermined head-related transfer function.

16. The sound reproducing apparatus according to claim 13, wherein the analysis section stores a predetermined head-related transfer function, and obtains the ear-canal correction filter convolved with the head-related transfer function.

17. A sound reproducing apparatus reproducing sound by using an in-ear earphone, the sound reproducing apparatus comprising:

a measurement signal generating section for generating a measurement signal;

a signal processing section for, in a state where the in-ear earphone is worn in an ear of a listening person, outputting the measurement signal from the in-ear earphone to an ear canal of the listening person by using a speaker function of the in-ear earphone, and measuring, with the in-ear earphone, the signal reflected by an eardrum of the listening person by using a microphone function of the in-ear earphone;

an analysis section for: calculating a simulation signal for a state where the in-ear earphone is not worn in the ear of the listening person by performing resampling processing on the signal measured by the signal processing section; analyzing the signal measured by the signal processing section and the simulation signal; and obtaining an ear-canal correction filter; and an ear-canal correction filter processing section for, when sound is reproduced from a sound source signal, convolving the sound source signal with the ear-canal correction filter obtained by the analysis section.

18. The sound reproducing apparatus according to claim 17, further comprising an HRTF processing section, which is provided at a preceding stage of the ear-canal correction filter processing section, for convolving the sound source signal with a predetermined head-related transfer function.

19. The sound reproducing apparatus according to claim 17, further comprising an HRTF processing section, which is provided in a subsequent stage of the ear-canal correction filter processing section, for convolving the sound source signal convolved with the ear-canal correction filter with a predetermined head-related transfer function.

20. The sound reproducing apparatus according to claim 17, wherein the analysis section stores a predetermined head-related transfer function, and obtains the ear-canal correction filter convolved with the head-related transfer function.

* * * * *